US006253406B1

(12) United States Patent
Holland

(10) Patent No.: US 6,253,406 B1
(45) Date of Patent: Jul. 3, 2001

(54) COMBINED TOOTHBRUSH HANDLE AND STAND

(76) Inventor: John Holland, 4030 Elderbank Dr., Los Angeles, CA (US) 90031

( * ) Notice: Subject to any disclaimer, the term of this patent is extended or adjusted under 35 U.S.C. 154(b) by 0 days.

(21) Appl. No.: 09/302,538

(22) Filed: Apr. 30, 1999

(51) Int. Cl.[7] ..... A46B 9/04
(52) U.S. Cl. ..... 15/143.1; 15/167.1
(58) Field of Search ..... 15/143.1, 167.1; 132/308, 309; D4/104, 108, 132

(56) References Cited

U.S. PATENT DOCUMENTS

| | | | |
|---|---|---|---|
| 287,791 | | 1/1883 | Arnaud . |
| 289,583 | | 1/1883 | Chan . |
| 292,448 | | 10/1884 | Vianello . |
| 301,402 | | 6/1884 | Hirsch . |
| D. 408,997 | * | 5/1999 | Holland . |
| 2,417,874 | * | 3/1947 | Kehl . |
| 5,875,516 | * | 3/1999 | Blue ..... 15/167.1 |

OTHER PUBLICATIONS

Reach Toothbrush—Mfg. is Johnson & Johnson–not Susre of Patent for This Art Which I Mentioned in Specification. My Invention differs from this prior art. My invention provides for additional support creating improved stability.

* cited by examiner

*Primary Examiner*—Terrence R. Till

(57) ABSTRACT

Heretofore, the average commercially available toothbrush had to depend on surfaces not attached to the toothbrush itself in order for the toothbrush to be stored when not in use, either in a holder often of questionable hygiene attached to a wall, in a drinking glass or other makeshift storage position. The unique feature of the combined toothbrush handle and stand as described in this application provides for the efficient, hygienic storage in a single unit, permitting the toothbrush bristles to air dry in an upright position free from contact with any surface. This is created by flexible moveable shafts set into the handle which are easily extended or retracted by the toothbrush user with the aid of a moveable ring to which the shafts are attached, thus creating a fully deployable stand alone base.

1 Claim, 3 Drawing Sheets

COMBINED TOOTHBRUSH HANDLE AND STAND

CROSS REFERENCE TO RELATED APPLICATIONS

This invention uses the design and artwork of my recently allowed Design Application for a Combined Toothbrush and Stand, application Ser. No. 29/059,360 now U.S. Pat. Des. No. 408,997.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention is intended for use as part of the oral-care industry and provides for an improved way in which to store a toothbrush.

BRIEF SUMMARY OF THE INVENTION

The unique feature of the combined toothbrush handle and stand as described in this patent application provides for the efficient, hygienic storage in a single unit which permits the toothbrush bristles to air dry in an upright positon free from contact with any surface.

BRIEF DESCRIPTION OF SEVERAL VIEWS OF THE DRAWING

Drawings numbered 1 through 4 are submitted herewith as part of this this application and describe the claimed invention.

Drawings indicated as FIGS. 1 through 4 are described as follows:

FIG. 1. shows two shafts set into the handle 3. Two more identical shafts not visible in FIG. 1 would be located on the opposite part of the handle.

Figure 4:
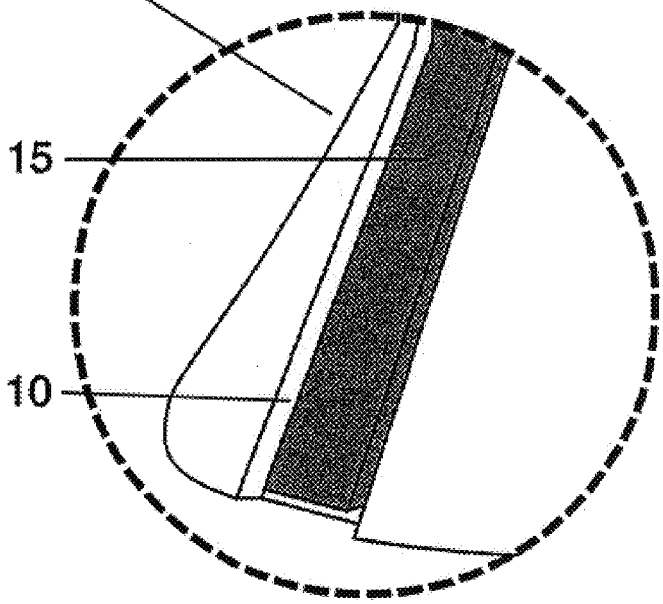
FIG.4. This enlarged drawing of flared base 7 shows the construction of one support shaft 15 set into groove of handle 10.

The elements of the toothbrush as shown in the drawings which comprise the brush head 16 with bristles 13 and stem 14 attached to the flared base 7, FIG. 4 of the handle 1 form no part of the claimed toothbrush handle invention.

DETAILED DESCRIPTION OF THE INVENTION

Prior to the invention presented herewith, there have been limited attempts to create a stand alone tooth brush. Toothbrush manufacturers concentrate on creating new and more efficient brush heads, but no companies known to this inventor in the United States adequately addresses the question of toothbrush storage. Yet this is of considerable concern for toothbrush users in general, especially for travellers who often brush in questionable environments (such as hotel bathrooms which may not have been adequately cleaned), and who wish to air dry a toothbrush in a hygienic environment after use. The possibility for substandard hygiene holds true for hospitals, schools, gymnasiums, the military, as well as for the average home. Only one commercially available children's toothbrush known to this inventor attempts to create a stand alone base. The manufacture of the children's "REACH" toothbrush has recognized the need for a stand alone toothbrush which allows for storage in a clean environment—immediatlely after use—of the wet toothbrush. However, the manufacturer's design is of a fat, round handled brush which is unstable. It has no support mechanism to create stability and is easily knocked over. This instability makes the brush head vulnerable to debris in the environment. It is the only attempt known to this inventor to create a stand alone brush now available in the commercial toothbrush market.

What is needed is a toothbrush handle which allows for easy packaging, is of a simple but effective design containing an easily manufactured mechanism which permits the stable and convenient storage of a wet toothbrush on a flat surface, independent of any support, apart from the toothbrush handle itself. The new toothbrush handle presented herein contains these merits.

The applicant has examined scores of toothbrush handles and toothbrush handle support mechanisms. Those which have been made with a stand alone base, as in the case of the above-mentioned REACH toothbrush for children, and those as shown in patented toothbrushes located during a previous patent search are unstable. Moreover, the latter patented toothbrush bases are not designed to retract. Toothbrush bases which do not retract make packaging difficult and expensive. The toothbrush base presented in this application retracts to the shape of a standard toothbrush and thus can be packaged and displayed in standard-size toothbrush display racks in stores without the need for special packaging.

The toothbrush handle is constructed of two kinds of plastic:

1. a hard plastic for all parts of the handle except for the shafts which create the stand alone base;

2. a soft plastic for the shaft portions which create the stand alone base. This plastic material is made of flexible plastic such as poly-ethylene-tere-phthalate. This soft plastic provides for flexibility required to allow the shafts to curve slightly over the flared base of the handle. It's flexible composition also provides an added safety feature especially for children so that they do not poke themselves with a more rigid material. This soft plastic will not affect the stability of the toothbrush base.

Figure 1:
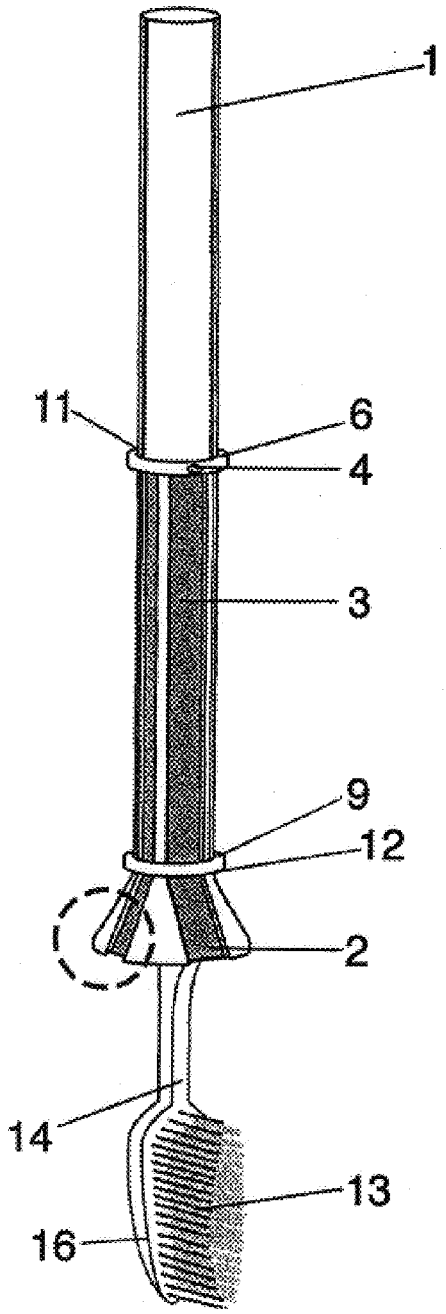
FIG.1. This drawing shows the handle 1 as illustrated in FIG. 1 in its retracted position 2. The handle consists of two or more support shafts 3. Shown here is a configuration of four shafts set at equal distance from each other around the handle 3. Two of four support shafts 3 are visible in this drawing and are shown in grey.
Figure 2:
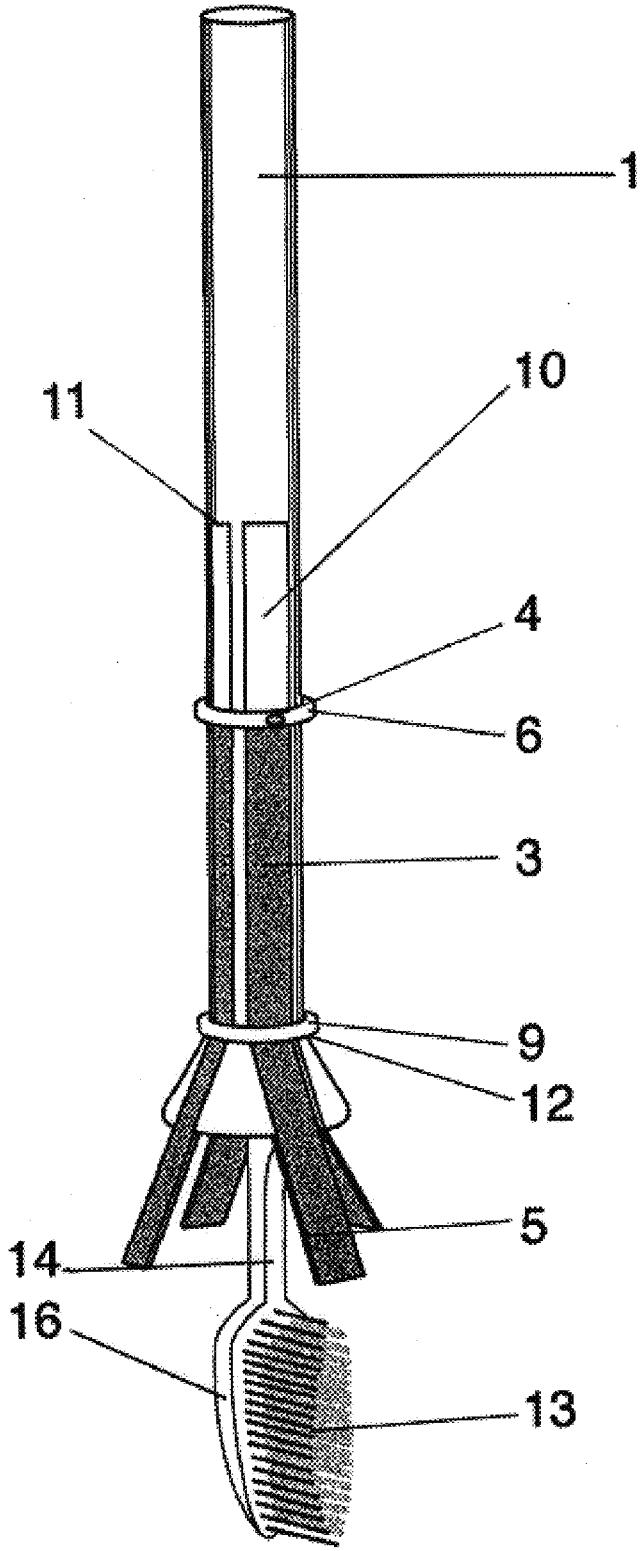
FIG. 2. This drawing shows the four shafts in their partially extended position 5. Note that the shafts are attached to a moveable ring 6 with a fixed button 4 mounted on ring's surface. Said button facilitates the moving of the ring up or down along the handle.
Figure 3:
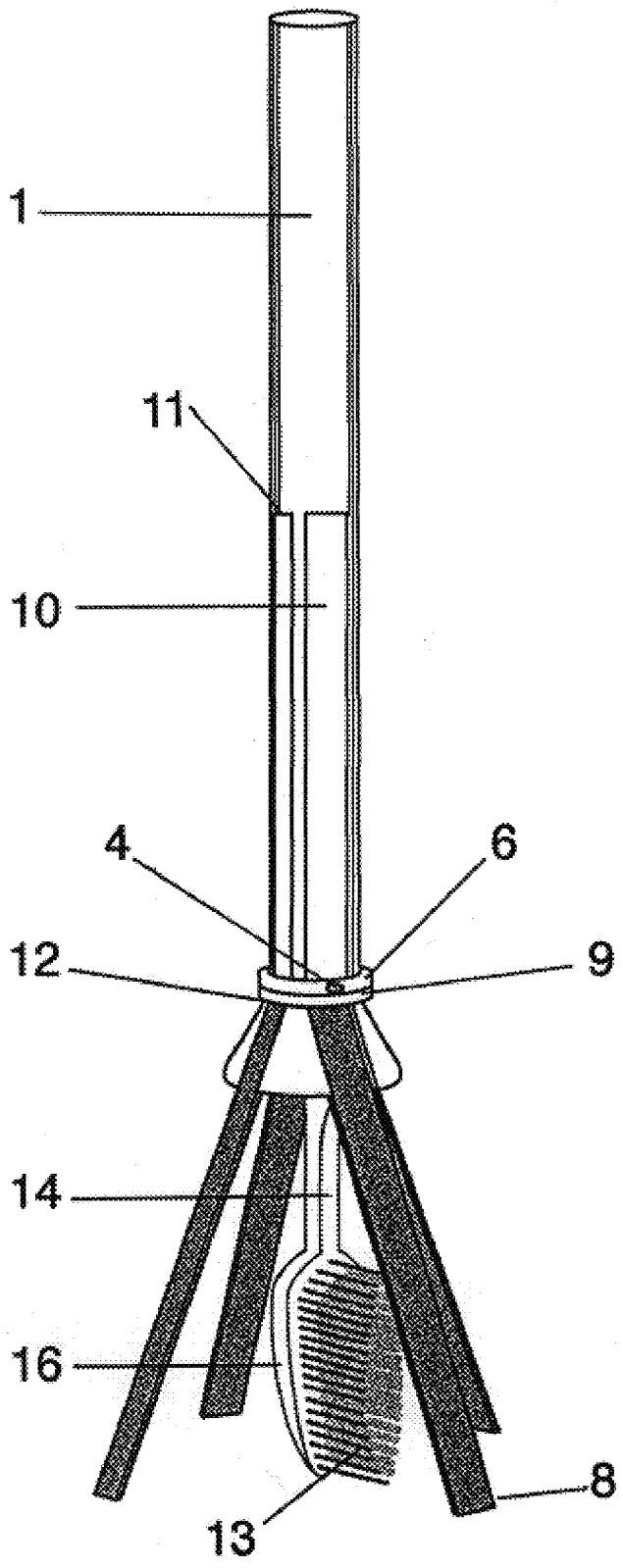
FIG. 3. This drawing shows the toothbrush handle 1 in its fully extended position 8 in which moveable ring 6 and fixed ring 9 are in contact with each other.

The combined toothbrush handle and stand provides for two or more shafts 5, FIG. 2 which are set into fluted paths or grooves 10, FIG. 4 in the handle and are attached to a moveable ring 6 encircling the handle. The shafts 5 are attached to the moveable ring 6 only, as shown in FIGS. 1, 2, and 3. The shafts 5 move up and down along the respective fluted pathways 10, FIG. 4 when the moveable ring 6 is moved by the user with the aid of a fixed button 4 mounted on the surface of the upper ring.

In order to retract or extend the shafts 5, the user moves the ring with the aid of said button 4 allowing for the shafts

5 to move in their respective tracts or pathways 10, either up or down along the toothbrush handle. When the user wishes to store the toothbrush after use, the moveable ring 6 is pushed downward toward the brush head. As the shafts 5 move downward these flexible shafts pass under the second ring 9 which is stationary, located at the uppermost part 12 of the flared portion 7 of the handle base. This stationary ring 9 holds the shafts 5 in place in their respective pathways 10. As the shafts move under the stationary ring 9 and over the flared based 7 of the handle 1, they are moved outward at an angle until they are fully deployed. In their fully deployed position, the shafts 5 stand on any flat surface and are of a length which maintains the brush head in a position approximately ½" to ¾" above the surface, thereby protecting the brush head 16 and bristles 13 from coming in contact with the surface on which the handle 1 is placed.

The claimed invention described herein provides important improvements to current toothbrush designs in ease of use, convenient storage and improved hygiene.

I claim:

1. A combined toothbrush handle and stand in which:

a) two plastic rings surround a toothbrush handle, one being moveable located at or near the midpoint of said toothbrush handle's length and to which are attached flexible shafts which traverse said toothbrush handle's length from at or near handle's midpoint to and over a flared base, b) said shafts which are moved toward handle's base when said moveable ring is moved with the aid of a fixed button mounted on the surface of said moveable ring, thereby enabling said shafts to pass under the second ring which is stationary, located at an uppermost part of flared base of the handle and which serves to keep the shafts in place as they are moved along their respective pathways, outward at an angle over said flared base thereby permitting shafts to become fully deployed.

* * * * *